United States Patent [19]

Tajima

[11] Patent Number: 4,653,415

[45] Date of Patent: Mar. 31, 1987

[54] METHOD OF FEEDING A CLOTH IN AN EMBROIDERY MACHINE

[75] Inventor: Ikuo Tajima, Nagoya, Japan

[73] Assignee: Tokai Kogyo Mishin Kabushiki Kaisha, Kasugai, Japan

[21] Appl. No.: 896,878

[22] Filed: Aug. 15, 1986

Related U.S. Application Data

[62] Division of Ser. No. 826,092, Feb. 6, 1986, Pat. No. 4,628,843.

[30] Foreign Application Priority Data

Feb. 7, 1985 [JP] Japan ..... 60-23199
Mar. 9, 1985 [JP] Japan ..... 60-33925

[51] Int. Cl.[4] ..... D05B 97/00; D05B 21/00

[52] U.S. Cl. ..... 112/262.2; 112/262.3; 112/308

[58] Field of Search ..... 112/262.3, 262.1, 262.2, 112/63, 121.12, 121.11, 121.15, 2, 308, 309

[56] References Cited

U.S. PATENT DOCUMENTS

| | | | |
|---|---|---|---|
| 3,052,197 | 9/1962 | Judelson | 112/63 |
| 3,448,707 | 6/1969 | Thomsen | 112/63 X |
| 4,467,733 | 8/1984 | Martin | 112/2 |
| 4,506,611 | 3/1985 | Parker et al. | 112/262.2 X |
| 4,530,294 | 7/1985 | Pollmeier et al. | 112/63 |

*Primary Examiner*—H. Hampton Hunter

*Attorney, Agent, or Firm*—Dennison, Meserole, Pollack & Scheiner

[57] ABSTRACT

A method and apparatus are presented for feeding a cloth in an embroidery machine. The method comprises the steps of holding the embroidery area of the cloth in a substantially arcuate manner about a horizontal axis disposed below the needle location and parallel to the Y axis of the Cartesian coordinate system the origin of which is the needle location, and feeding the cloth in the direction of the Y axis, while at the same time, feeding the cloth along the arcuate path about the horizontal axis.

Apparatus for performing the method is disclosed which comprises a transverse feed plate mounted on the table and movable in the direction of the Y axis, a longitudinal feed plate mounted on the table in operative association with the transverse feed plate and individually movable in the direction of the Y axis, a holder secured to the transverse feed plate, an interlocking bar operatively connected to the longitudinal feed plate for longitudinal movement therewith, a driving ring mounted on the holder for rotation about a horizontal axis disposed below the needle location and parallel to the Y axis, a cloth gripping frame mounted on the driving ring for holding the embroidery area of the cloth in a substantially arcuate manner about the axis of rotation of the driving ring, and a link motion for converting longitudinal movement of the longitudinal feed plate into a rotational movement of the driving ring.

2 Claims, 7 Drawing Figures

METHOD OF FEEDING A CLOTH IN AN EMBROIDERY MACHINE

This divisional of copending application Ser. No. 826,092 filed Feb. 6, 1986 now U.S. Pat. No. 4,628,843, dated Dec. 16, 1986.

BACKGROUND OF THE INVENTION

1. Field of the Invention

The present invention relates to a feeding apparatus in an embroidery machine which is used to feed a cloth of curved-face configuration such as that already sewed in a hat, a cap or clothing.

2. Description of the Prior Art

In the prior art, when such a cloth having a curved-face configuration is embroidered, the cloth has been spread in a flattened manner and horizontally fed to be embroidered. This, however, has limited patterns and area of embroidery and has caused deformation or flattening of patterns formed on the cloth. Furthermore, in the prior art embroidering operation, a cloth to be embroidered such as a hat has been held and set by a gripping frame secured to the sewing station. Thus, troublesome handling has been required to mount the cloth to the sewing station, and setting and spreading conditions of the cloth must be adjusted at the sewing station, making the setting operation more troublesome.

SUMMARY OF THE INVENTION

It is an object of the present invention to provide a method of feeding a cloth in an embroidery machine in which the cloth may be precisely embroidered with its embroidery area gripped in the arcuately curved state.

It is another object of the present invention to provide a cloth feeding apparatus in an embroidery machine which may precisely embroider a cloth having a curved-face configuration.

It is a further object of the present invention to provide a cloth feeding apparatus in an embroidery machine in which the cloth can be easily mounted to and removed from a gripping frame.

In accordance with the present invention, there is provided a method of feeding a cloth in an embroidery machine including a table, a reciprocable needle having an axis of rotation which is the origin of the X and Y axes of the Cartesian coordinate system, a longitudinal feed plate driven for movement along the X axis of the coordinate system, and a transverse feed plate driven for movement synchronously with the longitudinal feed plate along the Y axis of the coordinate system. The method comprises the steps of providing a cloth gripping frame rotatable about a horizontal axis disposed below the needle location and parallel to the Y axis, holding the embroidery area of the cloth on the cloth gripping frame in a substantially arcuate manner, and feeding the cloth gripping frame in the direction of the Y axis in operative association with the transverse feed plate, while at the same time, feeding the cloth gripping frame along the arcuate path about the horizontal axis in operative association with the longitudinal feed plate.

Also, in accordance with the present invention, there is provided apparatus for feeding a cloth in an embroidery machine having a table and a plurality of heads disposed above the table in parallel relation to each other, each of the heads having a reciprocable needle for forming embroidery stitches on a cloth, the needle having an axis of rotation which is the origin of the X and Y axes of the Cartesian coordinates with respect to the table. The apparatus comprises a tansverse feed plate mounted on the table and movable in the direction of the Y axis, a longitudinal feed plate mounted on the table in operative association with the transverse feed plate and individually movable in the direction of the X axis, a holder secured to the transverse feed plate, an interlocking bar operatively connected to the longitudinal feed plate for longitudinal movement therewith, a driving ring mounted on the holder for rotation about a horizontal axis disposed below the needle location and parallel to the Y axis, a cloth gripping frame mounted on the driving ring for holding the embroidery area of the cloth in a substantially arcuate manner about the axis of rotation of the driving ring, and means for converting longitudinal movement of the longitudinal feed plate into a rotational movement of the driving ring.

The present invention will become more fully apparent from the claims and the description as it proceeds in connection with the drawings.

DETAILED DESCRIPTION OF A PREFERRED EMBODIMENT

Figure 1:
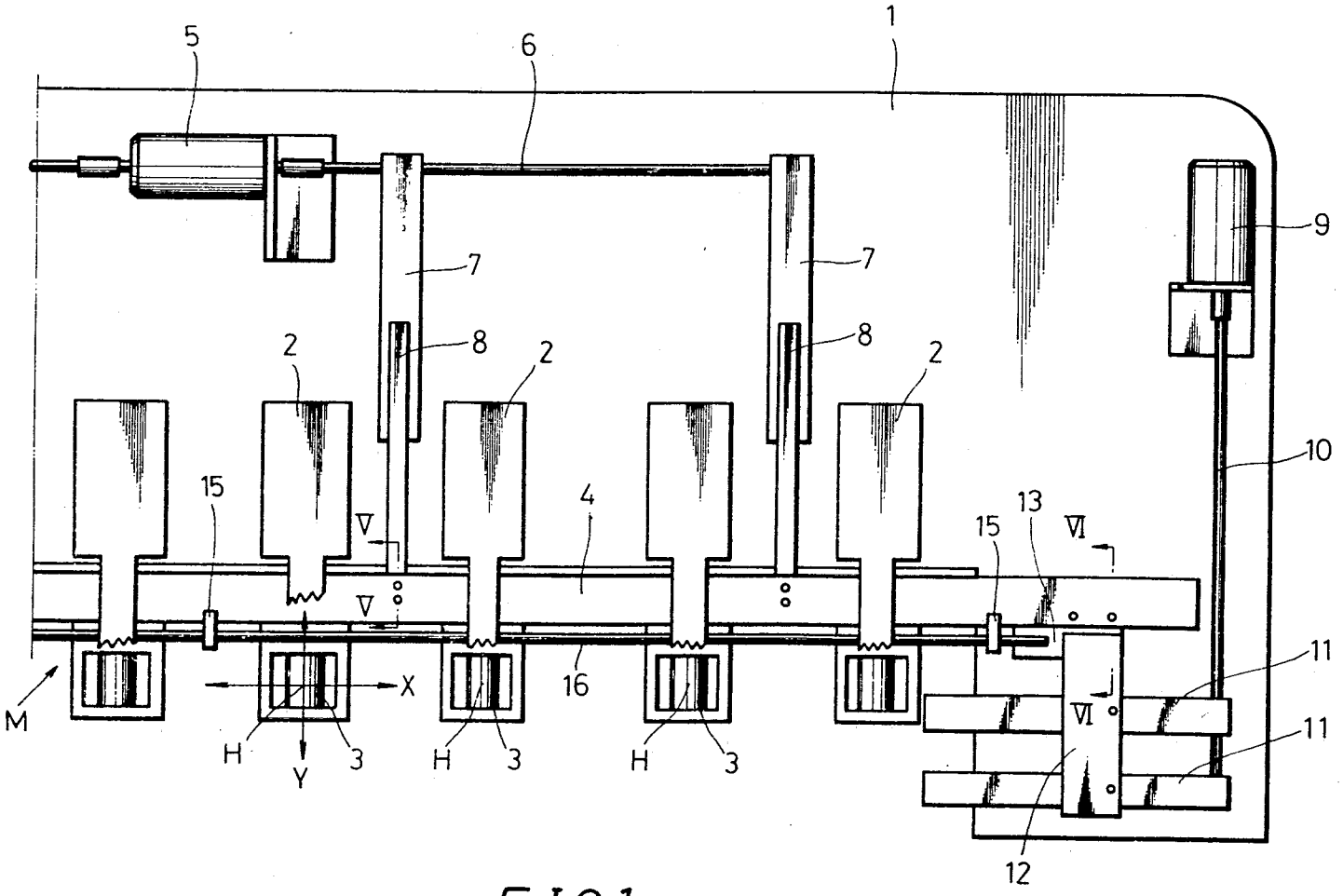
FIG. 1 is a somewhat simplified plan view of a portion of a multi-head embroidery machine for carrying out the method of the present invention, only five of the heads of the machine being shown.

Referring to the drawings and to FIG. 1 in particular, shown therein and generally designated by the reference character M is a multi-head embroidery machine in which the method of the present invention is performed. As shown therein, the embroidery machine has a table 1 and a plurality of heads 2 (five of them shown) disposed in longitudinally spaced relation to one another above the front end of the table 1. A plurality of lower sewing mechanisms 3 are provided under the front portion of the table 1, each being disposed in opposed relation to the respective heads 2. A transverse feed plate 4 of generally rectangular configuration is mounted on the table 1, extending under the front portion of the heads 2.

A transverse feed motor 5 is provided which serves to move the transverse feed plate 4 along the Y axis (in the transverse direction) of the Cartesian coordinate system supposed on the table 1 whose origin is the needle location H at which the needle (not shown) of each head 2 passes through a cloth to be embroidered. To this end, before the reciprocating movement of the needle is initiated, the transverse feed motor 5 is rotated in either the forward or the reverse direction, on the basis of Y data from a storage unit (not shown) in which X and Y data representative of an embroidery pattern is stored.

Figure 5:
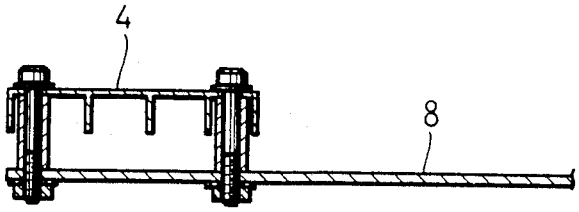
FIG. 5 is a sectional view as seen looking in the direction of the arrows of line V—V in FIG. 1.

A longitudinally extending transverse feed shaft 6 is provided and is connected to the motor shaft of the transverse feed motor 5. A pair of transverse feed belts 7 are trained around the transverse feed shaft 6. Each of the transverse feed belts 7 has secured thereto a transverse connecting plate 8 which in turn is connected to the transverse feed plate 4, as best shown in FIG. 5. Thus, when the transverse feed motor 5 is rotated in the forward or the reverse direction, the transverse feed plate 4 is moved along the Y axis through the transverse feed belts 7 and the transverse connecting plates 8.

Figure 6:
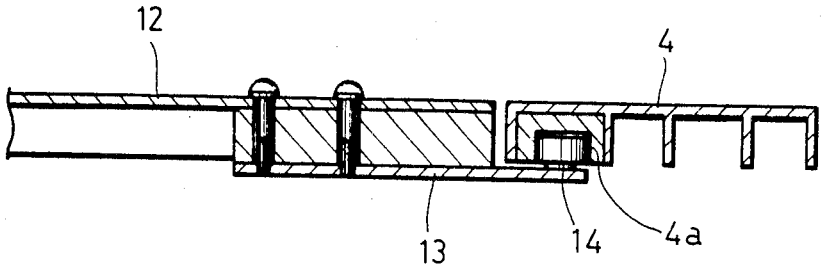
FIG. 6 is a sectional view as seen looking in the direction of the arrows of line VI—VI in FIG. 1.

A longitudinal feed motor 9 is provided which is controlled for rotation in synchronism with the transverse feed motor 5 on the basis of X data from the storage unit, and a transversely extending longitudinal feed shaft 10 is directly connected to the motor shaft of the longitudinal feed motor 9. A pair of longitudinal feed belts 11 are trained around the longitudinal feed shaft 10. A longitudinal feed plate 12 is slidably connected to the longitudinal feed plates 11 by means of cooperating rollers and ways (both not shown) for movement with the longitudinal feed plates 11 along the X axis and not along the Y axis. As best shown in FIG. 6, a longitudinal connecting plate 13 is attached to the rear end portion on the lower side of the longitudinal feed plate 12. The longitudinal connecting plate 13 is provided with rollers 14 (only one shown in FIG. 6) rotatably mounted on the rear end thereof and slidably received in a guide groove 4*a* in the transverse feed plate 4. Thus, the longitudinal feed plate 12 is operatively connected for movement with the transverse feed plate 4 along the Y axis and not along the X axis.

A plurality of supporting members 15 (two of them shown in FIG. 1) are mounted on the front portion of the transverse feed plate 4 and are disposed in spaced relation along the length thereof. An interlocking bar 16 is provided along the X axis adjacent the front of the transverse feed plate 4 and is slidably supported through the extreme end of each supporting member 15. The interlocking bar 16 is connected at the right end thereof (as viewed in the drawing) to the longitudinal connecting plate 13 and is movable with the longitudinal feed plate 12 along the X axis. Thus, when the longitudinal feed motor 9 is rotated in the forward or reverse direction, the interlocking bar 16 is moved with the longitudinal feed plate 12 along the X axis in synchronism with the movement of the transverse feed plate 4 along the Y axis.

While not shown in FIG. 1, a plurality of holders 17 are mounted on the lower side of the transverse feed plate 4 in opposed relation to the respective needle locations H. The task of the holders 17 is to support several components of the invention apparatus now to be described.

Figure 2:
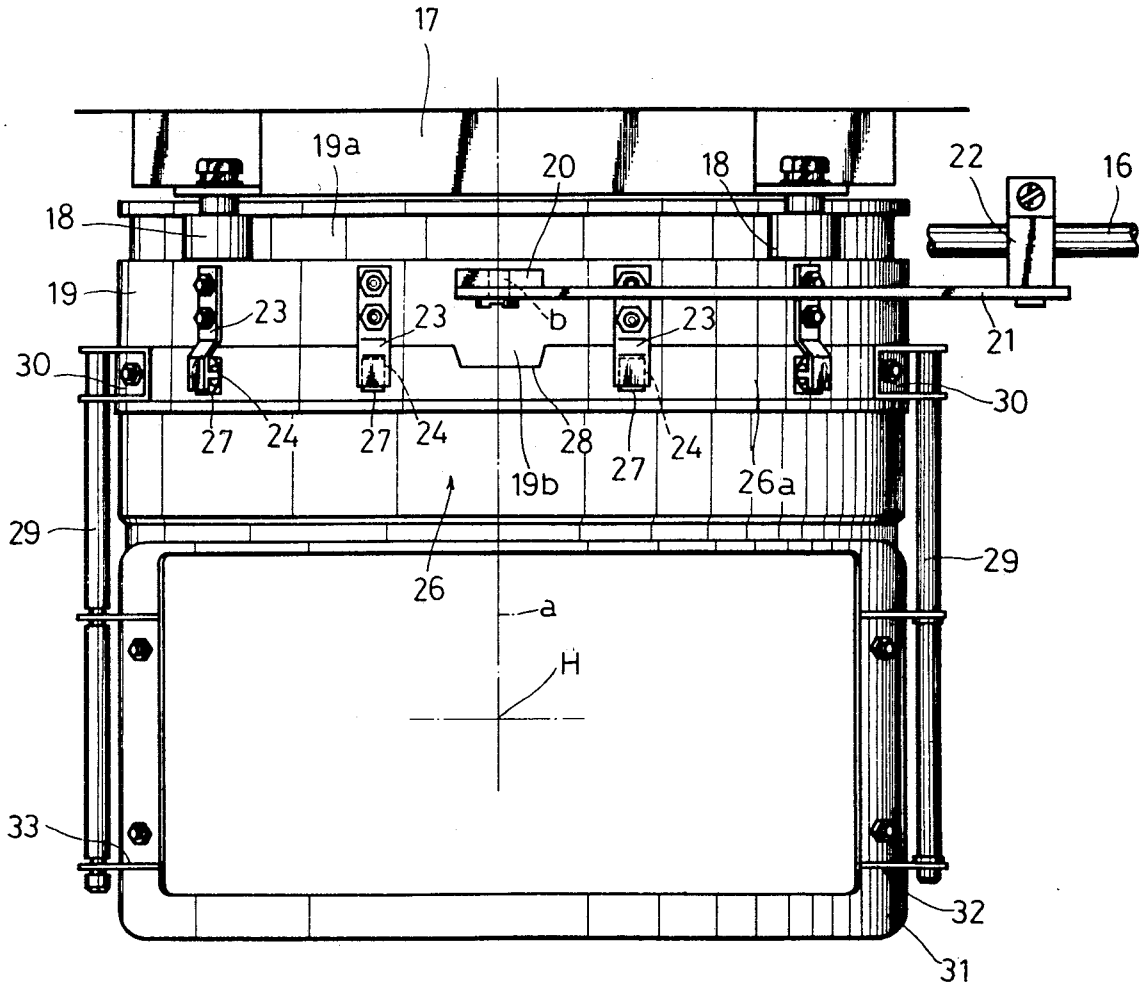
FIG. 2 is an enlarged plan view of the essential parts of the embroidery machine shown in FIG. 1.
Figure 3:
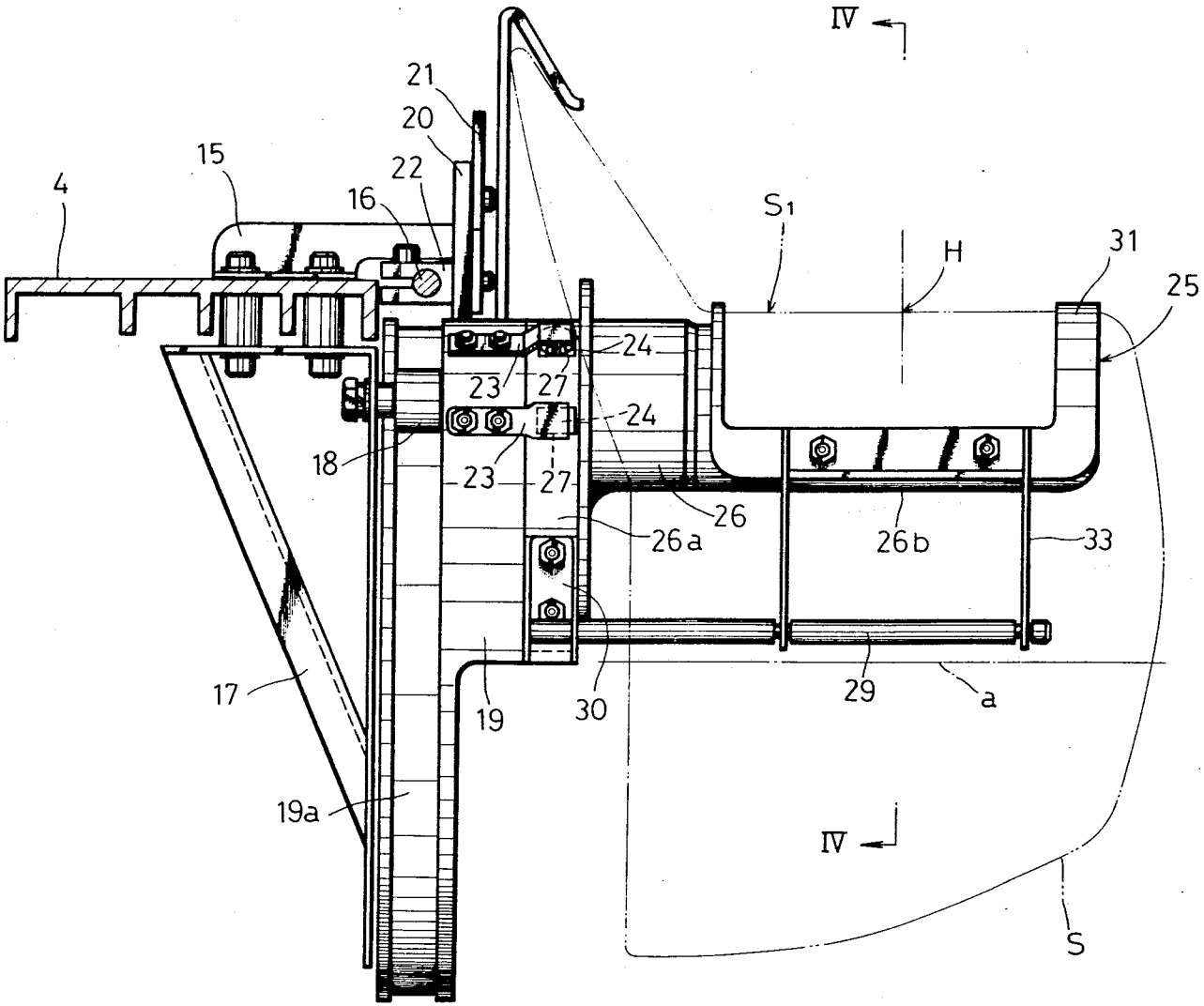
FIG. 3 is a side view of FIG. 2.
Figure 4:
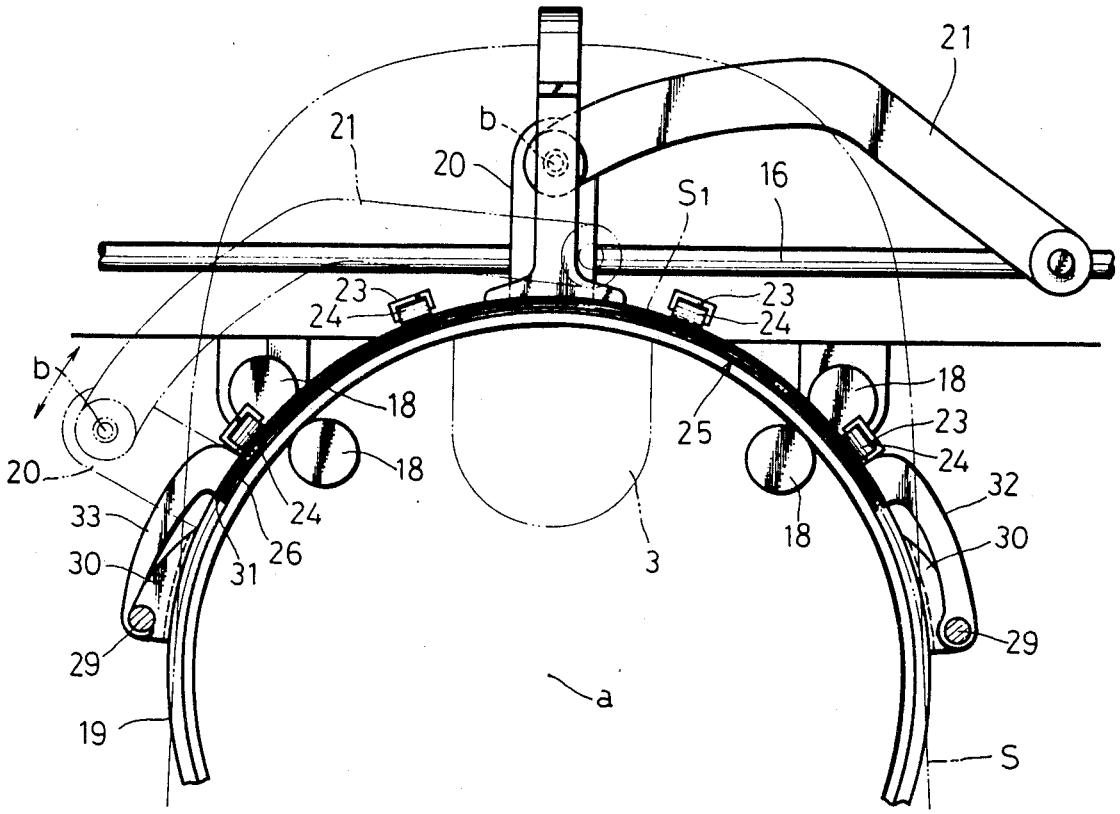
FIG. 4 is a sectional view as seen looking in the direction of the arrows of line IV—IV in FIG. 3.

Referring particularly to FIGS. 2, 3 and 4, each of the holders 17 is provided with dual pairs of guide rollers 18 rotatably mounted thereon adjacent the right and left upper ends thereof (FIG. 4). A substantially annular driving ring 19 is mounted on the front of the holder 17 through the guide rollers 18. The driving ring 19 has on the outer periphery thereof a circumferentially extending guide groove 19*a* in which the guide rollers 18 on the upper side are rotatably received. Thus, it is to be noted that the driving ring 19 is turnable about its horizontal axis a extending along the Y axis under the needle location H. The driving ring 19 has at the upper front portion thereof a positioning piece 19*b* projecting forwardly. The driving ring 19 also has an upstanding member 20 secured to the top periphery thereof.

A connecting arm 21 is pivoted at one end to the upstanding member 20 on the driving ring 19 and at the other end to a locking piece 22 fixedly connected to the interlocking bar 16. The connecting arm 21 serves to transmit linear movement of the interlocking bar 16 along the X axis to the driving ring 19 so that the latter may be selectively rotated. Thus, when the interlocking bar 16 is moved along the X axis, the driving ring 19 is turned in the forward or the reverse direction around the axis a by the angle corresponding to the travel of the interlocking bar 16. In this embodiment, the range of turning angle of the driving ring 19 is set between −60° to +60°.

A plurality of resiliently deformable roller holders 23 are arranged around the upper portion of the driving ring 19 in circumferentially spaced relation to one another. Each of the roller holders 23 rotatably supports a roller 24 at the front end thereof.

A cloth gripping frame 25 is provided in front of the driving ring 19 and adapted for holding the embroidery area S1 of a cloth S to be embroidered in arcuately spread state. The gripping frame 25 has a base frame 26 detachably mounted to the driving ring 19 to be rotated therewith and extending forwardly therefrom. The base frame 26 has an arcuate base end portion 26*a* mounted on the front end of the driving ring 19 and a holding portion 26*b* of an arcuate rectangular frame connected to the front end of the base end portion 26*a* and adapted for encircling the embroidery area S1. The base end portion 26*a* has rectangular engaging holes 27 for forwardly removably receiving the respective rollers 24 so as to mount the base frame 26 to the driving ring 19 for rotation therewith. As shown in FIG. 2, the base end portion 26*a* also has at the upper rear end surface thereof a recessed fitting portion 28 into which the positioning piece 19*b* of the driving ring 19 is fitted to determine the assembling position of the base frame 26 relative to the driving ring 19.

A pair of rods 29 are secured to and cantilevered from the right and left lower ends, respectively, of the base end portion 26*a* through mountings 30. A presser frame 31 is upwardly pivotally provided to be laid on the holding portion 26*b* of the base frame 26 so as to releasably hold the cloth S around the embroidery area S1 in cooperation with the base frame 26, the cloth S being spread in an arcuate manner around the axis of rotation a. The presser frame 31 is of curved rectangular configuration similar to the holding portion 26*b*, having one end pivotally mounted to one of the rods 29 through a hinge 32 and the other end disengageably locked to the other rod 29 through a lock member 33. Thus, the cloth S, having the embroidery area S1 held between the base frame 26 and the presser frame 31 in the form of arcuate surface around the axis a, is fed with the driving ring 19 along the Y axis and synchronously fed arcuately in the direction of the X axis along the arcuate surface around the axis a.

In operation, the embroidery area S1 of the cloth S is held between the base frame 26 and the presser frame 31 to be set in an arcuately spread manner. When the transverse feed motor 5 and the longitudinal feed motor 9 are synchronously driven for rotation on the basis of X and Y data from the storage unit in which an embroidery pattern is stored, movement of the transverse feed plate 4 along the Y axis causes movement of the embroidery area S1 along the axis a which is the axis of rotation of the embroidery area S1 arcuately held, and at the same time, movement of the interlocking bar 16 along the X axis causes movement of the embroidery area S1 in the arcuate direction about the axis a. Thus, the embroidery area S1 is fed, prior to every sewing cycle, by composite movements which consist of movement along the axis of rotation of the arcuate path formed about the axis a and movement in the peripheral direction of the arcuate path, permitting formation of the embroidery pattern corresponding to the X and Y data on the embroidery area S1.

It is to be noted, however, that the turning angle of the driving ring 19 corresponding to the travel of the interlocking bar 16 is varied according to the position of point b at which the upstanding member 20 of the driving ring 19 is operatively connected with the connecting arm 21, and consequently arcuate travel of the cloth S corresponding to the linear travel of the interlocking bar 16 is varied between the central portion and end portions of the embroidery area S1 (maximum at the central portion and gradually reduced toward the end portions). Therefore, a compensation data table is prepared in which the linear travel of the interlocking bar 16 corresponding to the proper arcuate travel of the embroidery area S1 is calculated at every position of the connecting point b, and such data table is stored in the storage unit as the X data for rotating the longitudinal feed motor 9.

Figure 7:
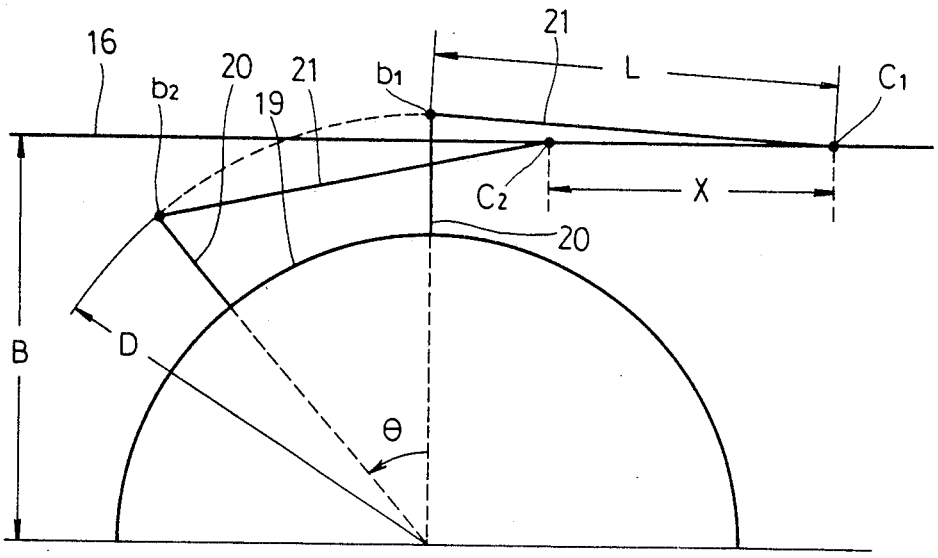
FIG. 7 is a schematic illustration showing the relation between the rotational angle of the driving ring and the amount of travel of the interlocking bar.

This relation will now be described in greater detail with reference to FIG. 7. Assume that when the point at which the upstanding member 20 of the driving ring 19 is operatively connected with the connecting arm 21 is positioned at $b_1$ shown in FIG. 7, the center of the embroidery area S1 is positioned at the needle location. At this time, the connecting arm 21 is operatively connected with the interlocking arm 16 at point $C_1$. Then, the amount of travel X of the interlocking bar 16 required to rotate the driving ring 19 by angle $\theta$, is found to be:

$$X = \sqrt{L^2 - (D - B)^2} - \sqrt{L^2 - (D\cos\theta - B)^2} + D\sin\theta \quad (1)$$

where L is the length of the connecting arm 21; B is the distance between the center of the driving ring 19 and the interlocking bar 16; and D is the distance between the center of the driving ring 19 and the point at which the upstanding member 20 is operatively connected with the connecting arm 21. It is to be noted that when the angle $\theta$ in counterclockwise is positive and the amount of travel X in leftward is positive as shown in FIG. 7, the equation (1) holds for both positive and negative $\theta$.

In order to form a predetermined pattern on a cloth, the driving ring 19 has to be rotated a predetermined angle $\theta$. This angle $\theta$ is proportional to the coordinate in the X direction (let this value be $X_1$ data) of the stitches in the pattern to be embroidered. Thus, in order to obtain the predetermined angle $\theta$, the interlocking bar 16 has to be longitudinally moved on the basis of X data calculated by the equation (1).

In this embodiment, X data corresponding to $X_1$ data is previously calculated, and these X and $X_1$ data are stored in the data table. When the machine is in operation, X data is obtained from $X_1$ data by using the data table, to thereby control the longitudinal feed motor 9. In other words, when the $X_1$ data is varied, the cooresponding X data is obtained, so that the longitudinal feed motor 9 is rotated in proportion to the difference between the $X_1$ and X data.

The embroidery machine thus constructed according to the present invention can effectively form embroidery on the cloth S having a curved-face configuration, maintaining the three-dimensional form with no deformation of the curved-face configuration. Thus, the present invention is effective to avoid any deformation of the embroidered pattern and flattening of the embroidery area and consequently to provide a precise embroidered pattern on the three-dimensional embroidery area, improving appearance and commercial value of the embroidered cloth.

Furthermore, as the cloth gripping frame 25 may be removed from the driving ring 19 to attach the cloth S at a position apart from the sewing station under the head in such a manner that the embroidery area S1 is held in the properly spread state, the cloth S can be spread uniformly and setting oporation thereof to the sewing station is simplified.

Additionally, this embodiment includes the specific arrangement in which the linear movement of the interlocking bar 16 is transmitted to the driving ring 19 through the connecting arm 21 so that the gripping frame 25 is moved in a substantially arcuate manner. Thus, the gripping frame 25 can be precisely and positively actuated.

While the invention has been described with reference to a preferred embodiment thereof, it is to be understood that modifications or variations may be easily made without departing from the spirit of this invention which is defined by the appended claims.

What is claimed is:

1. In an embroidery machine including a table, a reciprocable needle having an axis of rotation which is the origin of the X and Y axes of the Cartesian coordinate system, a longitudinal feed plate driven for movement along the X axis of the coordinate system, and a transverse feed plate driven for movement synchronously with the longitudinal feed plate along the Y axis of the coordinate system, a method of feeding a cloth comprising the steps of:

providing a cloth gripping frame rotatable about a horizontal axis disposed below the needle location and parallel to said Y axis;

holding the embroidery area of the cloth on said cloth gripping frame in a substantially arcuate manner; and feeding said cloth gripping frame in the direction of said Y axis in operative association with said transverse feed plate, while at the same time, feeding said cloth gripping frame along the arcuate path about said horizontal axis in operative association with said longitudinal feed plate.

2. The method as defined in claim 1 wherein said second-mentioned feeding step further comprises the steps of:

providing a link motion between said longitudinal feed plate and said cloth gripping frame for converting the linear movement of said longitudinal feed plate into a rotational movement of said cloth gripping frame;

calculating the amount of linear movement of said longitudinal feed plate to find a predetermined rotational angle of said cloth gripping frame; and controlling said linear movement on the basis of the calculated data, thereby feeding the embroidery area of the cloth along the arcuate path about said horizontal axis of rotation of said cloth gripping frame.

* * * * *